US006585216B2

(12) United States Patent
Krapf

(10) Patent No.: US 6,585,216 B2
(45) Date of Patent: Jul. 1, 2003

(54) DOUBLE SIDED A-FRAME WITH ADJUSTABLE SLIDE TRACKS

(76) Inventor: Wallace A. Krapf, 1933 O'Neill Rd., Macedon, NY (US) 14502

( * ) Notice: Subject to any disclaimer, the term of this patent is extended or adjusted under 35 U.S.C. 154(b) by 0 days.

(21) Appl. No.: 09/944,911

(22) Filed: Sep. 4, 2001

(65) Prior Publication Data

US 2003/0042389 A1 Mar. 6, 2003

(51) Int. Cl.[7] ..... A47B 19/00

(52) U.S. Cl. ..... 248/441.1; 248/447; 248/448; 248/449

(58) Field of Search ..... 248/441.1, 444.1, 248/447, 447.1, 448, 449, 456, 460, 129, 211, 469, 432, 172, 188.5; 211/198

(56) References Cited

U.S. PATENT DOCUMENTS 2,273,361 A * 2/1942 Kozloff ..... 248/449
3,195,849 A * 7/1965 Maddox ..... 248/441.1
3,226,077 A * 12/1965 Killen ..... 248/448
3,330,524 A * 7/1967 Foley ..... 248/444.1
3,396,929 A * 8/1968 Brown ..... 248/211
4,165,856 A * 8/1979 Wiseheart ..... 248/449
4,824,064 A * 4/1989 Oncale ..... 248/441.1
5,308,035 A * 5/1994 Ross ..... 248/454
6,267,345 B1 * 7/2001 Turner ..... 248/447

* cited by examiner

*Primary Examiner*—Leslie A. Braun
*Assistant Examiner*—Tan Le
(74) *Attorney, Agent, or Firm*—Shlesinger, Fitzsimmons & Shlesinger

(57) ABSTRACT

An A-frame stand for supporting display boards is made from a pair of like, inverted, generally V-shaped end members and a pair of rigid cross pieces that extend between the end members to maintain them in spaced, vertical planes, and in registry with each other. A pair of board supporting tracks are adjustably mounted by a plurality of hanger elements to one or to both sides of the A-frame stand to extend between the end members in vertically-spaced, parallel relation to each other. Each hanger is in the form of a metal strap secured intermediate its ends to one side of a track at one end thereof, with opposite ends of the strap extending around a leg of an end member and being releasably secured together so as to allow vertical adjustment of each track on the stand. Each track has at least two longitudinally extending recesses or grooves in both its upper and lower surfaces for slidably accommodating one edge of a display board.

12 Claims, 3 Drawing Sheets

DOUBLE SIDED A-FRAME WITH ADJUSTABLE SLIDE TRACKS

BACKGROUND OF THE INVENTION

This invention relates to A-frame display stands, and more particularly to such stands which have adjustable slide tracks mounted thereon for supporting display boards thereon. Even more particularly this invention relates to A-frame stands of the type described which have mounted thereon improved, adjustable slide tracks which enable display boards of various sizes to be mounted on the both sides of associated stand.

There are currently available in the marketplace a variety of free-standing display board devices, such as for example those shown in U.S. Pat. No. 5,060,448 and U.S. Pat. No. Des. 342,757. These cabinets or stands slidably support thereon display boards which can be employed for displaying a variety of data. In most such devices extremely long, sturdy tracks are supplied for slidably supporting therein the lower edge of one or more display boards. This not only increases the costs of such devices, but also the weight thereof, and the difficulty at times in assembling and moving the devices. There are available also so-called A-frame stands for slidably supporting display boards in tracks located on opposite sides of a stand, but the tracks are fixed to the associated stand and thus limit the size of the boards which can be employed with such a stand.

It is an object of this invention, therefore, to provide an improved display board stand, which is substantially more inexpensive to manufacture, and easier to assemble.

Still another object of this invention is to provide an improved display board stand of the type described which utilizes display board supporting tracks that are adjustably mounted on the stand to accommodate display boards of different heights.

An even more specific object of this invention is to provide a stand of the type described which utilizes an A-frame configuration, and with novel, adjustable display board supporting tracks which are readily and adjustably mounted upon the legs of the stand at both sides thereof.

Other objects of the invention will be apparent hereinafter form the specification and from the recital of the appended claims, particularly when read in conjunction with the accompanying drawings.

SUMMARY OF THE INVENTION

An A-frame stand for supporting display boards includes a pair of inverted, generally V-shaped end members made from tubular metal, and each member having a pair of legs extending downwardly and away from each other. Each leg has an upper section secured at its lower end to the upper end of a lower section of the leg, and to one end of one of a pair or rigid cross pieces that extend between the end members to maintain them in spaced, vertical planes, and in registry with each other. A pair of elongate display board supporting tracks are adjustably mounted by a plurality of hanger elements to one or to both sides of the A-frame stand to extend horizontally between the two end members and in vertically-spaced, parallel relation to each other. Each hanger is in the form of a metal strap secured intermediate its ends to one side of one of the tracks at one end thereof, with opposite ends of the strap folded or otherwise extending around opposite sides of one of the legs of an end member and with opposite ends of the metal strap releasably secured together so as to allow vertical adjustment of each track on the stand. Each track has at least two longitudinally extending recesses or grooves in both its upper and lower surfaces.

THE DRAWINGS

DETAILED DESCRIPTION OF THE PREFERRED EMBODIMENTS

Figure 1:
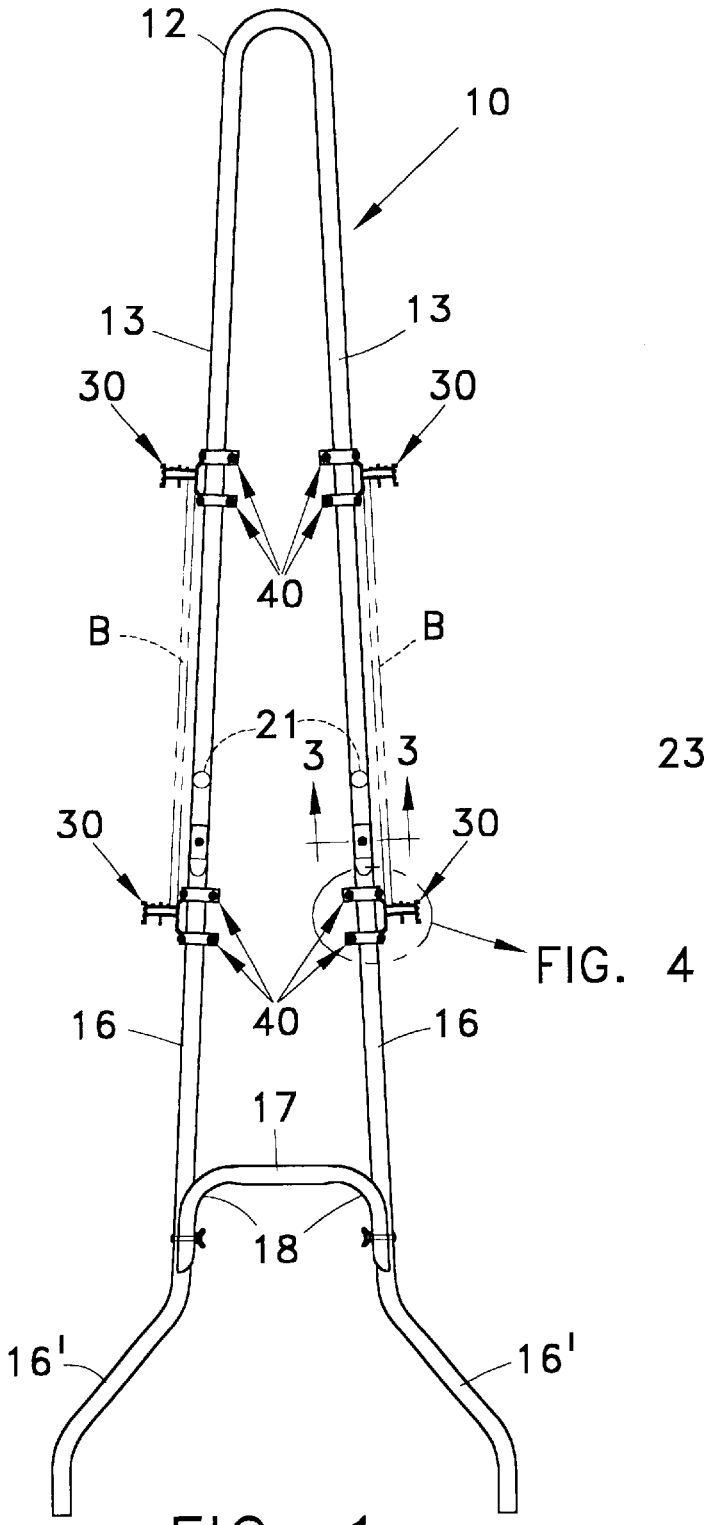
FIG. 1 is an end view of an A-frame stand made according to one embodiment of this invention having thereon adjustable slide tracks supporting on the stand a pair of display boards shown in phantom by broken lines.
Figure 3:
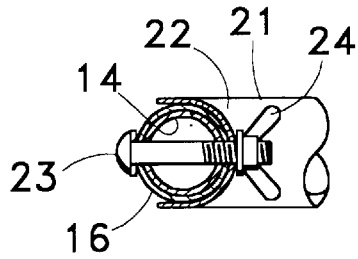
FIG. 3 is a slightly enlarged fragmentary section view taken generally along the line 3—3 in FIG. 1, and looking in the direction of the arrows.

Referring now to the drawings by numerals of reference, and first to FIGS. 1 and 2, numerals 10 denote generally a pair of like, generally inverted V-shaped end members which are secured in spaced, parallel relation to each other as noted hereinafter. Each member 10 comprises an upper, inverted, V-shaped section formed from an elongate metal tube bent medially of its ends as at 12 so that its legs 13, which form the upper leg sections of each member 10, extend downwardly and slightly away from each other. At their lower ends the tubular legs 13 have reduced diameter sections 14 (FIG. 3) which insert slidably and part way into the upper ends of a pair of tubular legs 16, which form the lower leg sections of each member 10, and which are secured intermediate their ends to opposite ends of a side cross member 17. As shown in FIG. 1, each cross member 17 may comprise a metal tube, opposite ends of which are bent downwardly as at 18 and have recessed surfaces engaged with confronting surfaces on the leg sections 16 just above the outwardly flared lower ends 16' thereof. Opposite ends 18 of each member 17 are secured by conventional bolt and wingnut combinations to the associated leg sections 16.

To secure together the lower ends of the leg sections 13 in the upper ends of leg sections 16, and also to secure the two end members 10 in spaced, parallel registering relation to each other, and thus forming a double sided A-frame, the end members 10 are secured to opposite ends of a pair of elongate, metallic tubular cross pieces 21. As shown more clearly in FIGS. 2 and 3, marginal end portions 22 of each cross piece 21 are curved or bent downwardly and have recessed outer surfaces for accommodating the junctures of adjacent frame leg sections 13 and 16. Also, each end portion 22 adjacent the lower end thereof is secured by a bolt 23 and wingnut 24 to the juncture of the adjacent frame leg sections 13 and 16. As shown more clearly in FIG. 3, the shank of each bolt 23 passes through registering openings in the associated leg sections 16, 14 and the registering end portion 22 of the associated cross piece 21.

Figure 4:
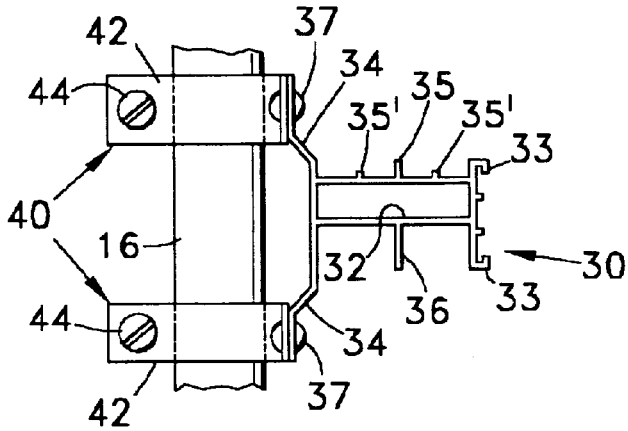
FIG. 4 is an enlarged fragmentary view of the portion of the stand encircled in FIG. 1.
Figure 5:
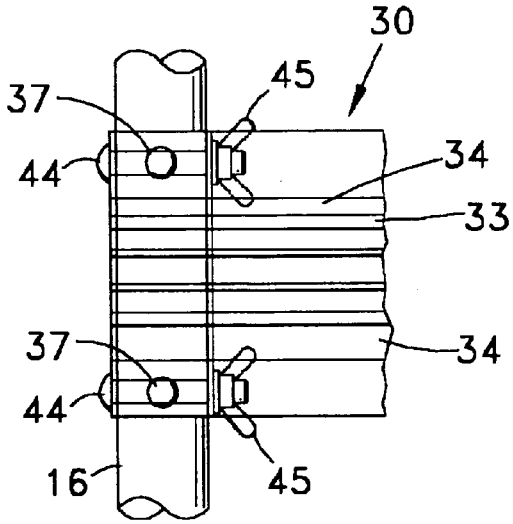
FIG. 5 is a fragmentary side view of this portion of the stand as seen when looking at the right end thereof as shown in FIG. 4.
Figure 6:
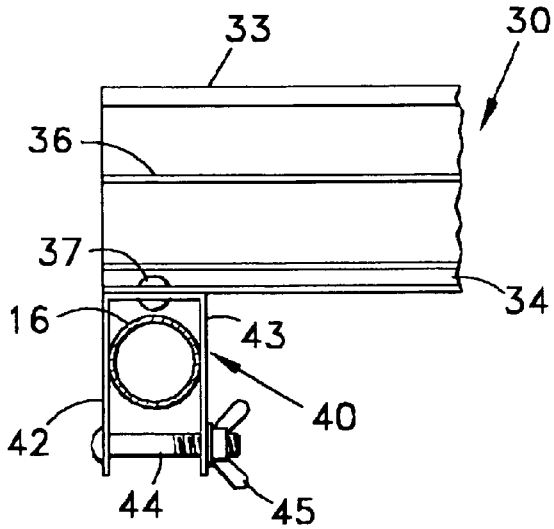
FIG. 6 is a fragmentary plan view of this portion as seen when looking at the lower end thereof as shown in FIG. 5.

Adjustably mounted on each side of the A-frame formed by the two interconnected end members 10 are two, elongate, display board supporting tracks, which are denoted generally by their numerals 30, and which by way of example may be made from extruded aluminum. As shown more clearly in FIG. 4, each track 30 has an elongate, hollow center section 32 which is rectangularly shaped in cross section. At the side thereof remote from the A-frame, each center section 32 has integral with the longitudinally extending edges thereof, a pair of spaced, parallel flanges 33 having confronting, recessed surfaces for releasably accommodating therein the opposed edges of paper or plastic cards, (not illustrated) which can be employed for displaying information on the surface of each track remote from the A-frame. At the side thereof confronting the A-frame the edges of the center section 32 of each track 30 have integral therewith, and projecting therefrom, a pair of spaced, longitudinally extending leg sections 34. Each track 30 has projecting medially and transversely from the upper and lower surfaces of its center section 32 as shown in FIGS. 4 and 6, narrow, longitudinally extending ribs 35 and 36, respectively.

Adjacent each end thereof, each track 30 has the two, spaced, leg sections 34 thereof secured by rivets 37 to a pair of metal straps or track hangers, which are denoted generally by the numerals 40. The center section of each metal strap or hanger 40, which is riveted to the leg section 34 of the track 30, has projecting therefrom a pair of space(4 leg sections 42 and 43 (FIG. 6). In order to adjustably secure a track 30 to the legs 16 of the end members 10, the legs 42 and 43 of each of the two hangers 40 at each end of a respective track 30, are passed around a tubular leg section 16, and the free ends thereof are then squeezed or bent together, if necessary. The free ends of the legs 42 and 43 of each hanger are then secured together by a bolt 44 the threaded shank of which passes through registering openings in the legs 42 and 43, and has secured thereover a wing nut 45 to secure the associated hanger 40 snugly to the associated frame leg 16. In this manner, opposite ends of each track 30 are mounted on the frame for vertical adjustment on the legs 16 or 13, as shown in FIG. 1.

Figure 2:
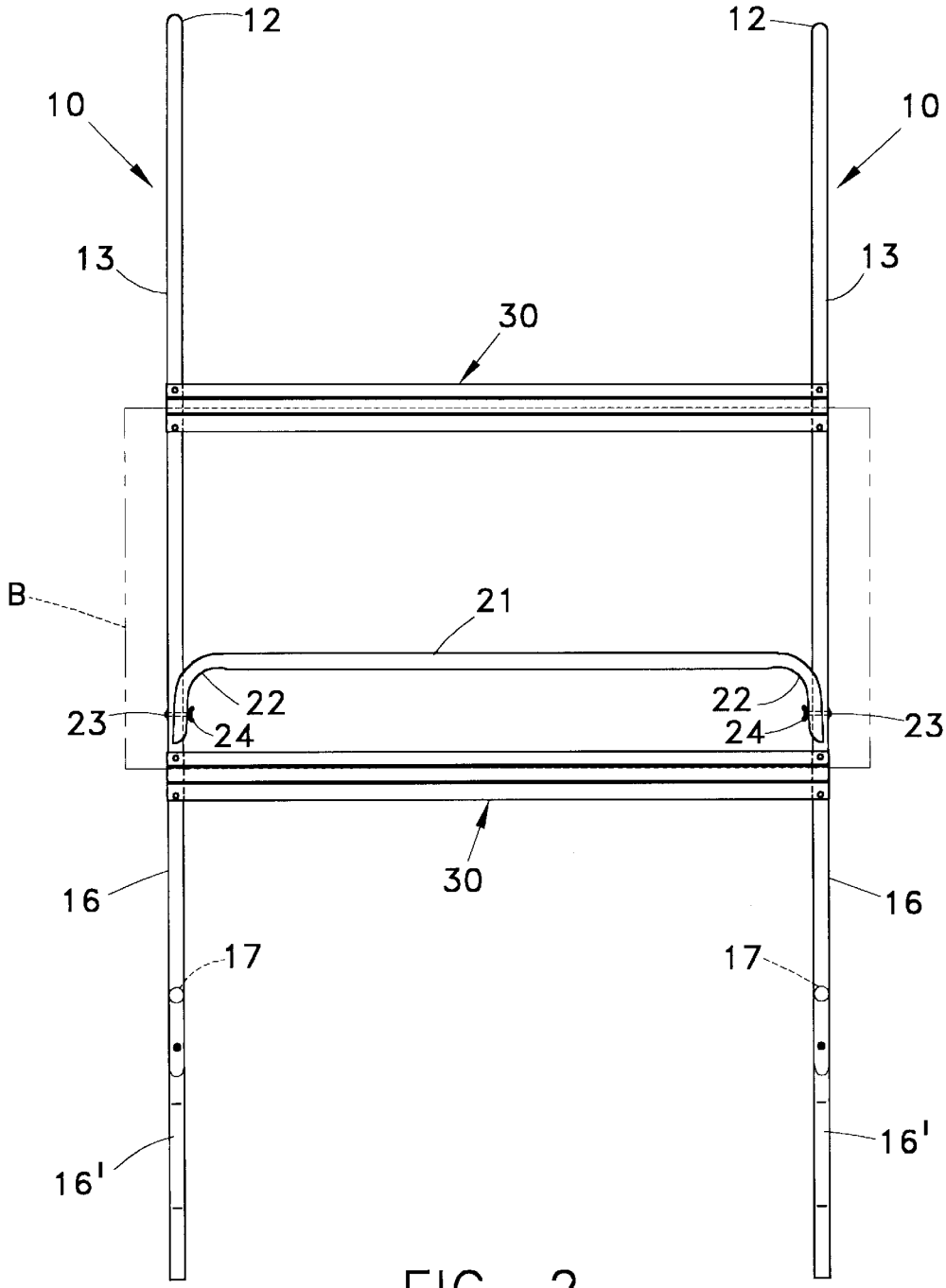
FIG. 2 is a front elevational view of the stand again with a display board thereon being shown in phantom by broken lines.

In use, rectangularly shaped display boards B, which are shown in phantom by broken lines in FIGS. 1 and 2, are adapted to be slidably mounted at each side of the A-frame between the pair of tracks 30 mounted on that side of the frame. The upper surface of each track 30, as shown in FIG. 4, is divided by an integral rib 35 into two adjacent grooves, each of which is adapted slidably to accommodate the lower end of a display board B, one such groove being located between the rib 35 and the track leg section 34, and the other groove between the rib 35 and the flange 33 on the upper surface of the track. The lower surface of each track is also divided into two grooves by an integral rib 36. The track rib 36, which has a height slightly greater than that of the rib 35, also divides the lower space between the adjacent flange 33 and leg section 34 into two adjacent grooves. In the embodiment illustrated, the lower edge of each board B is mounted for sliding movement in the recess on the upper surface of a track 30 between the rib 35 and leg section 34, while the upper edge of each such board B is disposed to slide in the groove in the underside of the upper track 30 between the rib 36 and the adjacent leg 34. Although only one board B has been illustrated at each side of the frame shown in FIG. 1, it will be apparent, that if desired, two such boards may be mounted between each pair of rails 30 simply by placing a second board in sliding engagement with the outer grooves in the top and bottom surfaces of the tracks 30 - i.e., the grooves adjacent flanges 33. Also, as shown in FIG. 4, if desired, each of the grooves in the upper surface of track 30 may have disposed centrally thereof very slight or shallow ribs 35' engagable with the bottom of a display board B to ease sliding adjustment of a board in the associated groove.

From the foregoing it will be apparent that the present invention provides a relatively simple and inexpensive means for providing a very light but very stable A-frame capable of having mounted on each side thereof one or more slidably adjustable display boards. In turn, the tracks supporting such boards, and hence the boards themselves, can be readily and vertically adjusted on a respective side of the A-frame, simply by momentarily releasing the clamping effect of the legs 42 ands 43 of each associated hanger 40. This also enables the stand to accommodate boards of a variety of different heights. Further than this, the components of the A-frame are not only sturdy, but are very light and enable the associated A-frame to be easily moved or adjusted when necessary.

While this invention has been illustrated and described in detail in connection with only certain embodiments thereof, it will be apparent to one skilled in the art that the invention is capable of still further modification, and that this application is intended to cover any such modifications as may fall within the scope of one skilled in the art or the appended claims.

What is claimed is:

1. A stand for supporting display boards, comprising a pair of inverted, generally V-shaped end members made from tubular metal, and each of said members having a pair of legs extending downwardly and away from each other, means securing said two end members in spaced, parallel, registering relation with each other, and for supporting said members on said legs thereof in essentially spaced, vertical planes, means removably mounting a pair of elongate display board supporting tracks on said members to extend horizontally between said members and a registering pair of said legs thereof, and in vertically spaced parallel relation to each other, said mounting means comprising a pair of hanger elements secured to each of said tracks adjacent each end thereof, means for releasably securing the two hanger elements adjacent each end of each of said tracks for vertical adjustment on one of a pair of spaced, registering legs of said end members, said mounting means being operative to mount each of said tracks on said members with one of two longitudinally extending surfaces on each track facing upwardly and the other of said two surfaces facing downardly, each of said two surfaces having therein at least one groove extending between and opening on opposite ends of the associated track, and each of said grooves being disposed to slidably accommodate therein one edge of a display board.

2. A stand as defined in claim 1, wherein each of said legs of said end members comprises an upper tubular section having a lower end, a lower tubular section having an upper end, and fastening means releasably securing together the lower end of said upper section of each of said legs coaxially to the upper end of the lower section thereof.

3. A stand as defined in claim 2, wherein said means securing said two end members in spaced relation comprises a pair of rigid cross pieces extending between said end members in spaced, parallel relation to each other, and secured at opposite ends thereof by said fastening means to a pair of registering legs of said end members.

4. A stand as defined in claim 3, including means extending between and securing the two legs of each of said members in spaced relation to each other.

5. A stand as defined in claim 1, wherein each of said hanger elements comprises a metal strap secured intermediate its ends to one side of one of said tracks adjacent one end thereof, each of said metal straps has opposite ends thereof extending around diametrally opposite sides of one of said pair of spaced, registering legs of said end members, and the two ends of each of said metal straps are releasably secured together.

6. A stand as defined in claim 5, wherein there are two of said straps secured in spaced relation to each other to said one side of each of said tracks adjacent each end thereof, and opposite ends of each of said two straps extend around diametrally opposite sides of the same leg of one of said end members.

7. A stand as defined in claim 1, wherein each of said two surfaces of each of said tracks has therein at least two parallel grooves extending longitudinally between said opposite ends thereof.

8. An A-frame stand for supporting display boards, comprising a pair of similar, inverted, generally V-shaped end members each having a pair of legs extending away from each other and equidistantly from the midpoint of the associated end member, a pair of rigid cross pieces extending in spaced relation between, and secured at opposite ends thereof to said end members to support said members on said legs thereof, and in spaced, registering relation, means removably mounting a plurality of elongate display board supporting tracks on said members to extend horizontally between said members, and in vertically spaced relation to each other, each of said tracks having longitudinally extending upper and lower surfaces, respectively, and each of said surfaces having therein at least one longitudinally extending recess for slidably accommodating one edge of a display board, and said mounting means including a pair of hanger devices secured to each of said supporting tracks adjacent opposite ends thereof, and releasably and adjustably secured to a pair of spaced, registering legs of said end members to permit vertical adjustment of a respective track relative to said end members.

9. An A-frame stand as defined in claim 8, including means extending between and securing the two legs of each of said end members in spaced relation to each other.

10. An A-frame stand as defined in claim 8, wherein each of said hanger devices comprises a pair of metal straps secured intermediate their ends to one side of a respective track adjacent one end thereof, and in spaced relation to each other, and with opposite ends of each of said straps passing around one of said legs of one of said members and being releasably secured together at the side of the respective leg remote from the track to which the respective strap is secured.

11. An A-frame stand as defined in claim 8, wherein each of the two legs of each of said end members includes an upper section having a lower end, and a lower section having an upper end registering with the lower end of the upper section of the same leg, and means releasably secures the registering ends of two of said leg sections together and to one end of one of said cross pieces.

12. An A-frame stand as defined in claim 10, wherein each of said tracks in the side opposite said one side thereof has therein a longitudinally extending groove for releasably accommodating an information piece therein.

* * * * *